US011597474B2

(12) United States Patent
Lazzara et al.

(10) Patent No.: US 11,597,474 B2
(45) **Date of Patent: *Mar. 7, 2023**

(54) FULL BEAM SUPERSTRUCTURE LOWER DECK

(71) Applicant: Euro Marine Group Ltd, Tortola (VG)

(72) Inventors: Joseph Lazzara, Tampa, FL (US); Ian Ombres, Tampa, FL (US)

(73) Assignee: Euro Marine Group Ltd., Tortola (VG)

( * ) Notice: Subject to any disclaimer, the term of this patent is extended or adjusted under 35 U.S.C. 154(b) by 0 days.

This patent is subject to a terminal disclaimer.

(21) Appl. No.: 17/383,525

(22) Filed: Jul. 23, 2021

(65) Prior Publication Data

US 2021/0347440 A1 Nov. 11, 2021

Related U.S. Application Data

(63) Continuation of application No. 16/811,724, filed on Mar. 6, 2020, now Pat. No. 11,084,554.

(60) Provisional application No. 62/814,602, filed on Mar. 6, 2019.

(51) Int. Cl.
*B63B 1/12* (2006.01)
*B63B 15/00* (2006.01)

(52) U.S. Cl.
CPC ..... *B63B 1/121* (2013.01); *B63B 15/00* (2013.01)

(58) Field of Classification Search
CPC ..... B63B 1/121; B63B 15/00
See application file for complete search history.

(56) References Cited

U.S. PATENT DOCUMENTS

| | | | | |
|---|---|---|---|---|
| 5,191,848 | A | 3/1993 | Hatfield | |
| 5,595,132 | A | 1/1997 | Bystedt et al. | |
| 7,685,955 | B2 | 3/2010 | Keck | |
| 11,084,554 | B2 * | 8/2021 | Lazzara | B63B 1/121 |

FOREIGN PATENT DOCUMENTS

| | | |
|---|---|---|
| CN | 207208366 | 4/2018 |
| GB | 1336591 | 11/1973 |

* cited by examiner

*Primary Examiner* — Stephen P Avila
(74) *Attorney, Agent, or Firm* — McHale & Slavin, P.A.

(57) ABSTRACT

A catamaran having two parallel symmetrical hulls of equal size spaced apart with a superstructure lower deck extending from an outer edge of the first hull to an outer edge of the second hull. The lower deck is positioned above the static waterline and provides a single, constant, flush elevation height across the entire length and breadth of the vessel, with the placement of control and propulsion machinery in the hulls. The improved catamaran has an increased freeboard, increased gross tonnage, and decreased design pressures on the superstructure scantlings of the catamaran deck as compared to a conventional catamaran having a lower deck mounted beneath the static waterline, or accommodations added to the hulls.

7 Claims, 4 Drawing Sheets

FULL BEAM SUPERSTRUCTURE LOWER DECK

PRIORITY CLAIM

In accordance with 37 C.F.R. § 1.76, a claim of priority is included in an Application Data Sheet filed concurrently herewith. Accordingly, the present invention claims priority to U.S. Provisional Patent Application No. 62/814,602, entitled "FULL BEAM LOWER DECK" filed Mar. 6, 2019, through U.S. patent application Ser. No. 16/811,724, entitled "FULL BEAM LOWER DECK" filed Mar. 6, 2020, the contents of which are incorporated herein by reference.

FIELD OF THE INVENTION

This invention relates to improvements in watercraft of the catamaran type. More particularly, it relates to a twin hull catamaran having a constant, flush elevation deck height for the entire length and breadth of the catamaran vessel.

BACKGROUND OF THE INVENTION

A catamaran is a vessel formed from two parallel hulls of equal size that are laterally spaced apart from one another. The catamaran is a geometry-stabilized vessel deriving its stability from its wide beam, reducing both heeling and wave-induced motion. In comparison, a mono-hull vessel derives its stability from a central point and requires mechanical stabilization, such as a gyro or stabilizer fins, to obtain stability otherwise inherent in the catamaran.

Catamaran vessels typically have less hull volume, higher displacement, and a shallower draft then a mono-hull vessel of a comparable length. Two hulls have less hydrodynamic resistance than a mono-hull, thereby requiring less propulsive power. A catamaran hull experiences resistance to passage through water that is approximately proportional to the square of its speed; whereas a displacement mono-hull experiences resistance that is at least the cube of its speed, requiring larger power plants to match catamaran speed.

A conventional catamaran has a lower deck positioned beneath a static waterline in each hull. Each hull is used for living accommodations, and the space between the hulls can be used as a technical space, or the technical space is shared with the accommodation space. The inconveniences of deck height elevations varying over the entire length and breadth of a catamaran to access living accommodations directly affects the accommodation space square footage of a vessel and acceptable gross tonnage of the vessel.

What is lacking in the industry is a catamaran design having a superstructure lower deck that provides a constant, flush elevation height for the entire length and breadth of a catamaran vessel, thereby increasing the square footage accommodation space of the vessel.

SUMMARY OF THE INVENTION

Disclosed is a catamaran having two hulls spaced apart with a lower deck extending from an outer edge of the first hull to the outer edge of the second hull. The lower deck is positioned above the static waterline and provides a single, constant, flush elevation height for the deck across the entire length and breadth of the vessel.

An objective of the invention is to teach the use of a lower deck having a constant, flush elevation height for the entirely length and breadth of a vessel.

Another objective of the invention is to teach the use of a lower deck positioned above the static waterline of a catamaran vessel, as compared to the lower deck of a conventional catamaran having a lower deck positioned beneath the static waterline.

Still another objective of the invention is to provide an improved catamaran having an increased freeboard over that of a conventional catamaran.

Another objective of the invention is to decrease design pressures on the superstructure scantlings of catamaran decks.

Yet still another objective of the invention is to increase the gross tonnage of a catamaran over a conventional catamaran.

Other objectives and advantages of this invention will become apparent from the following description taken in conjunction with any accompanying drawings wherein are set forth, by way of illustration and example, certain embodiments of this invention. Any drawings contained herein constitute a part of this specification, include exemplary embodiments of the present invention, and illustrate various objects and features thereof.

DESCRIPTION OF THE PREFERRED EMBODIMENT

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
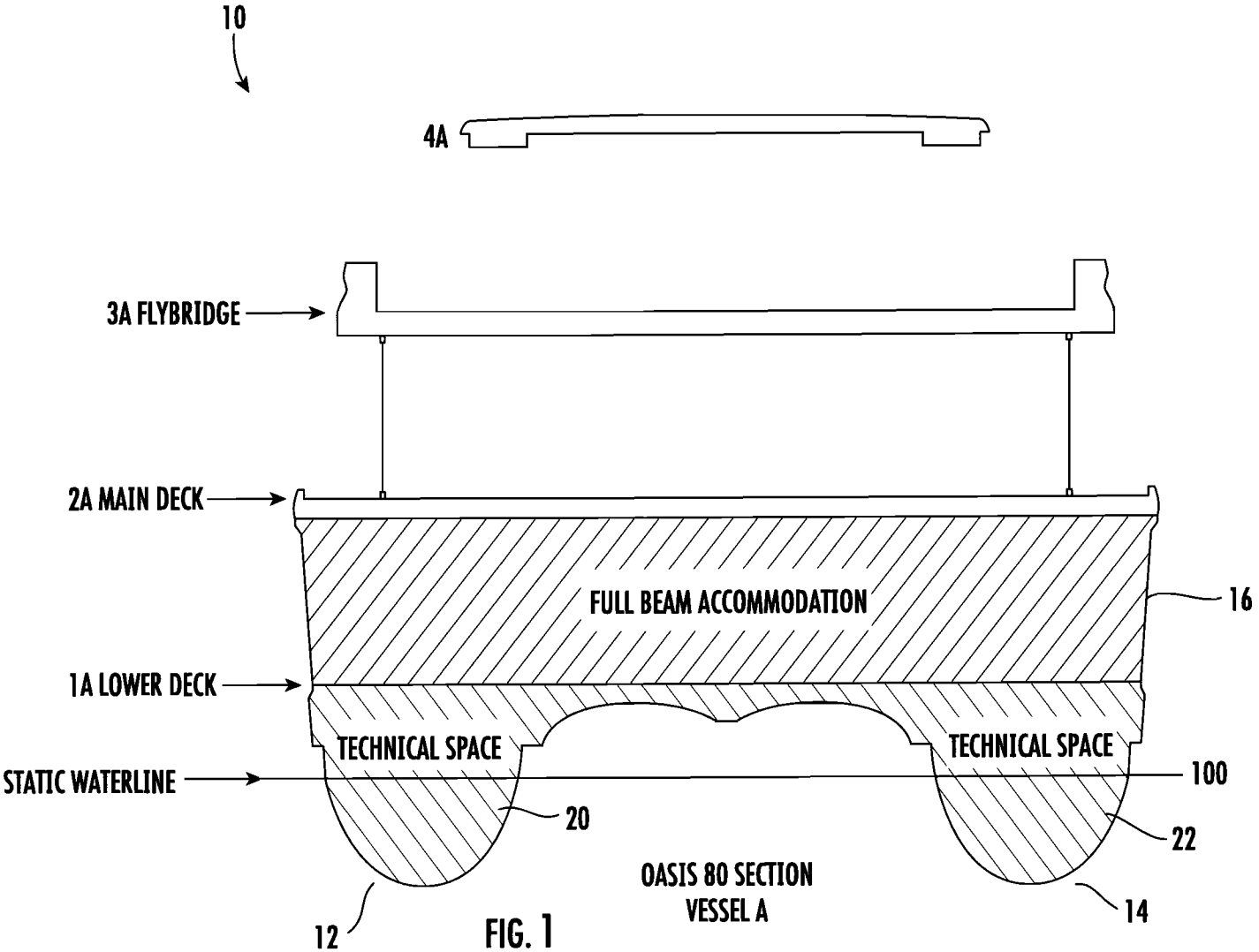
FIG. 1 is a pictorial view of the flush elevation deck for a catamaran of the instant invention.
Figure 2:
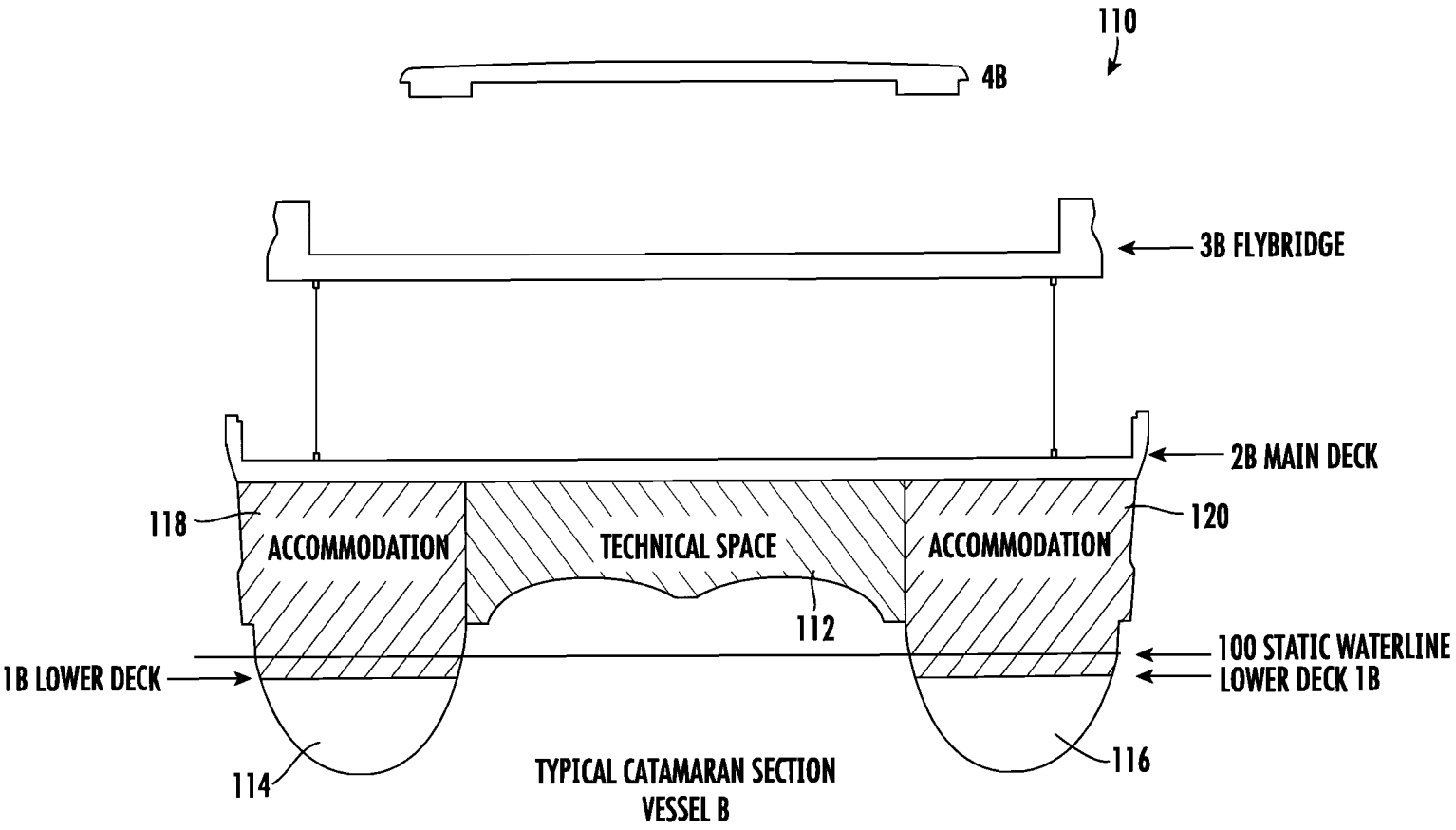
FIG. 2 is a pictorial view of a conventional catamaran.

Referring in general to FIGS. 1 and 2, illustrated is a catamaran vessel 10 having a first hull 12 laterally spaced apart from a second hull 14. The first and second hull are secured together by a superstructure lower deck 1A, which is a constant, flush elevation height for the entire length and breadth of the vessel 10. The superstructure lower deck 1A is positioned above a static waterline 100, providing an increased freeboard height distance from the static waterline 100 to a main deck 2A over a conventional catamaran 110, as depicted in FIG. 2, which illustrates a smaller freeboard height distance from the static waterline 100 to a main deck 2B. The catamaran vessel 10 of the instant invention always has increased superstructure heights according to the large commercial yacht code (LY3). LY3 classifies one standard superstructure height as 1800 mm. Therefore, catamaran vessel 10 has the ability to decrease design pressures on superstructure scantlings of deck 2A and deck 3A, as compared with conventional catamaran vessel 110 deck 2B and deck 3B. When catamaran vessel 10 and conventional catamaran vessel 110 are of the same length and breadth, the accommodation space 16 square footage of catamaran vessel 10 is increased over conventional catamaran vessel 110 due to deck 1A placement on the catamaran vessel 10 shown in FIG. 1, versus a split lower deck 1B placement on the conventional catamaran vessel 110 shown in FIG. 2. Conversely, catamaran 10 has a first technical space 20 positioned in the first hull 12, and a second technical space 22 positioned in the second hull 14; whereas the conventional catamaran 110 has technical space 112 positioned between a first hull 114 and a second hull 116, or the technical space is combined with the accommodation space 118, 120. With the conventional catamaran shown in FIG. 2, positioning of the technical space 112 between the hulls may be used in some embodiments with a first set of accommodations 118 placed within the first hull 114, and a second set of accommodations 120 placed within the second hull 116. The result is the notorious small accommodations that owners of a conventional catamaran 110 must tolerate. This also leads to numerous deck heights used to reach the accommodations 118, 120 from the main deck 2B.

When catamaran vessel 10 and conventional catamaran vessel 110 are of the same length and breadth, catamaran vessel 10 has increased internal volume, accommodation space 16 volume and technical space 20, 22 volume. When catamaran vessel 10 and conventional catamaran vessel 110 are of the same length and breadth, catamaran vessel 10 has increased gross tonnage over conventional catamaran vessel 110, according to The International Convention on Tonnage Measurement of Ships 1969. For catamaran vessel 10, the actual freeboard to the weather deck exceeds that required by the International Convention on Tonnage Measurement of Ships 1969 by one standard superstructure height.

Figure 3:
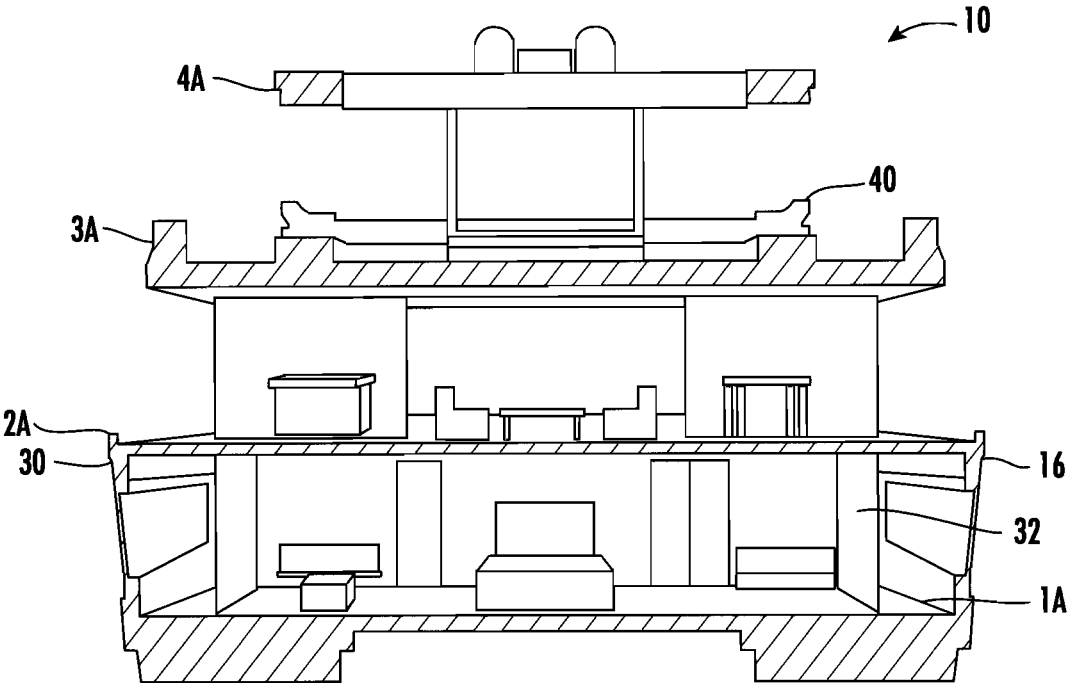
FIG. 3 is a cross sectional rear pictorial view of the flush elevation deck rearward section used for a full beam accommodation.
Figure 4:
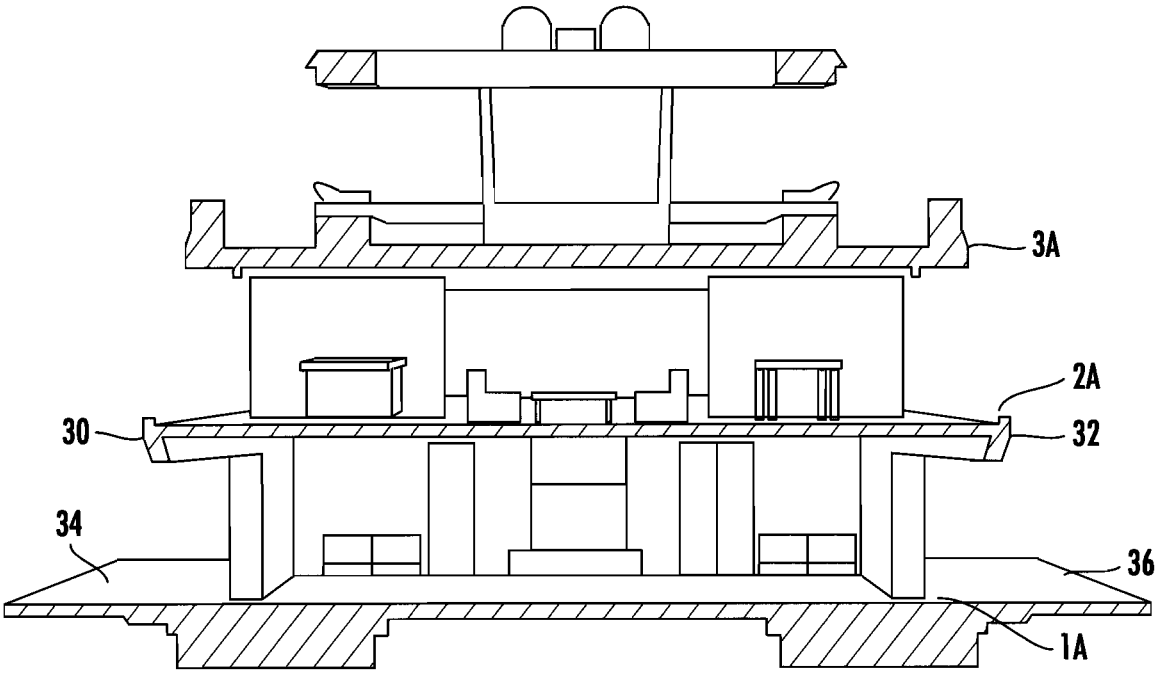
FIG. 4 is cross sectional rear pictorial view of FIG. 3 with sidewall porch doors in an open position.

Referring to FIG. 3, set forth is a cross sectional rear pictorial view of the catamaran vessel 10 having a structural lower level flush elevation deck 1A used for a full beam accommodations 16, namely from the port sidewall 30 to the starboard sidewall 32. The full beam accommodations 16 allow for a beam to beam stateroom that is not otherwise possible on a conventional catamaran having a lower deck beneath the static waterline, or if the accommodations are included in the hull space. An upper or main deck 2A provides a constant, flush elevation height for the length and breadth of the vessel to maximize the volume of useable space over the lower deck 1A. A flybridge 3A is positioned over the main deck 2A, and a hardtop 4A is illustrated over the upper helm and seating area 40. FIG. 4 depicts a cross sectional view of the catamaran vessel 10, wherein a portion of the port sidewall 30 pivots outwardly to form a porch 34. Similarly, a portion of the starboard sidewall 32 pivots outwardly to form a porch 36. FIG. 4 illustrates the pivoting sidewall porch doors 34 and 36 in an open position.

Figure 5:
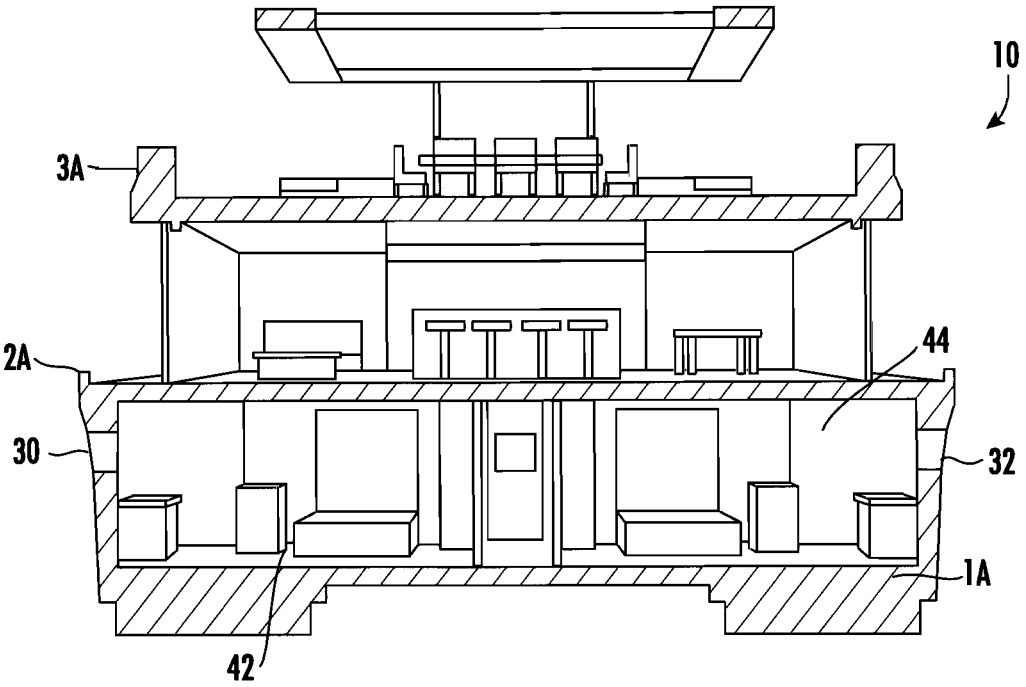
FIG. 5 is a cross sectional rear pictorial view of the flush elevation deck forward section used for multi-room accommodations.
Figure 6:
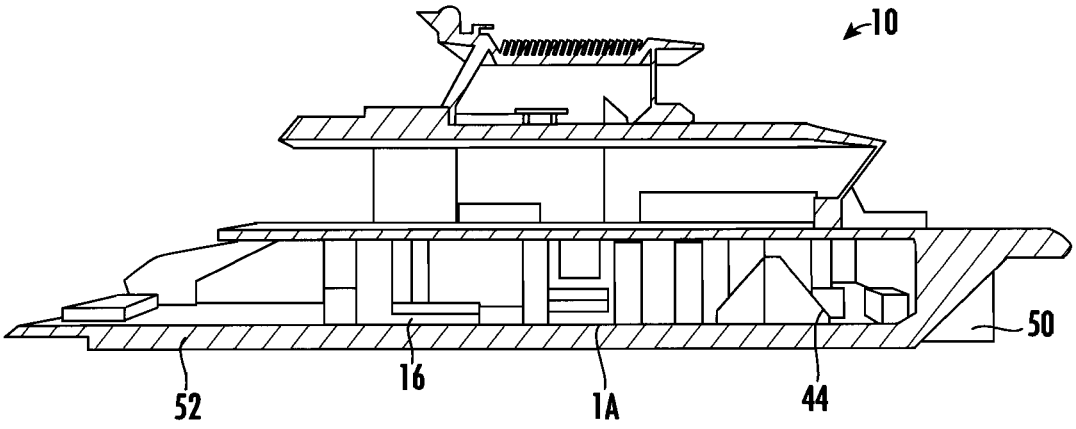
FIG. 6 is a cross sectional side view illustrating a pictorial view of the flush elevation deck extending from the front to the rear of the vessel.

FIG. 5 is a cross sectional rear pictorial view of the flush elevation deck 1A along a forward section of the vessel 10 to illustrate space used for multi-room accommodations and 44. FIG. 6 is a cross sectional side view of the vessel 10 illustrating a pictorial view of the flush elevation deck 1A extending from the front/bow 50 of the vessel 10 to the rear/stern 52 of the vessel 10.

In the preferred embodiment, the catamaran vessel comprises two parallel symmetrical hulls 12, 14 of equal size, each hull having a bow and a stern with a longitudinal bottom extending between the bow and stern forming a length. Each hull 12, 14 has an inner and outer sidewall 30, 32 extending above a static waterline 100 and secured to the superstructure lower deck 1A. The inner and outer sidewalls 30, 32 of each hull define a technical space 20, 22 for placement of control and propulsion machinery. The superstructure lower deck 1A is positioned above the static waterline 100 and extends over the inner and outer sidewalls of each hull; the superstructure lower deck having an upper surface constructed and arranged to provide a single, constant, flush elevation across the entire length and breadth of the hulls, creating a full beam accommodation space 16. A lower surface of the superstructure lower deck is secured to said hulls that are placed in a parallel spaced apart position. The technical space 20, 22 contains propulsion machinery, and the full beam accommodation space 16 is devoid of propulsion machinery.

A main deck 2A is positioned above the superstructure lower deck 1A, the main deck 2A having a flush elevation across the entire length and breadth of the hulls 12, 14. The main deck 2A is about the same length and width of the superstructure lower deck 1A to define a ceiling for accommodations, and may extend over the lower deck for shade and protection from the elements. The superstructure lower deck 1A is positioned along a level plane a fixed distance above the static waterline 100. The hull sidewalls 30, 32 are of a predetermined height above the static waterline, wherein no technical space is positionable between the hulls.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

The term "coupled" is defined as connected, although not necessarily directly, and not necessarily mechanically. The use of the term "or" in the claims is used to mean "and/or" unless explicitly indicated to refer to alternatives only or the alternative are mutually exclusive, although the disclosure supports a definition that refers to only alternatives and "and/or."

What is claimed is:

1. A full beam accommodation space for a catamaran vessel comprising two parallel symmetrical hulls of equal size that are spaced apart forming a port side hull and a starboard side hull, each said hull having a bow and a stern with a longitudinal bottom forming a length, each said hull having an inner sidewall and an outer sidewall extending above a static waterline defining a technical space in each hull for placement of propulsion machinery;

a superstructure lower deck secured to said port side hull and said starboard side hull at a predetermined position above said static waterline, said superstructure lower deck having an upper surface constructed and arranged to provide a single, constant, flush elevation across the entire length and breadth of said catamaran vessel creating a full beam accommodation space;

at least one sidewall secured to a side edge of said superstructure lower deck, said sidewall rotatable from a vertical storage position to a horizontal position extending said full beam accommodation space;

whereby said technical space within each said hull contains propulsion machinery and said full beam accommodation space formed on said upper surface of said superstructure lower deck extends from said port side hull to said starboard side hull and extendable outwardly therefrom by rotating said at least one sidewall, wherein said superstructure lower deck width is extended.

2. The catamaran vessel according to claim 1 including a main deck positioned above said superstructure lower deck, said main deck having a flush elevation spaced a distance above said port side hull and said starboard side hull.

3. The catamaran vessel according to claim 2 wherein said main deck is about the same length and width of said superstructure lower deck.

4. The catamaran vessel according to claim 1 wherein said superstructure lower deck is positioned along a level plane a fixed distance above said static waterline.

5. The catamaran vessel according to claim 1 wherein said first sidewall and said second sidewall are of a height to extend between said superstructure lower deck and said main deck above said static waterline, enclosing said superstructure lower deck between said port side hull and said starboard side hull.

6. The catamaran vessel according to claim 1 wherein said superstructure lower deck placement is constructed and arranged to decrease design pressure on superstructure scantlings.

7. The catamaran vessel according to claim wherein said superstructure lower deck placement is constructed and arranged to provide increased freeboard and gross tonnage over a conventional catamaran having accommodations placed in a portion of each hull.

* * * * *